United States Patent [19]

Shiraishi et al.

[11] Patent Number: 4,807,456

[45] Date of Patent: Feb. 28, 1989

[54] WORKPIECE TRANSFER DEVICE FOR PRESS MACHINE

[75] Inventors: Motoatsu Shiraishi; Mitsuki Nakamura; Ryoichi Kageyama, all of Saitama, Japan

[73] Assignee: Honda Giken Kogyo Kabushiki Kaisha, Tokyo, Japan

[21] Appl. No.: 125,391

[22] Filed: Nov. 25, 1987

[30] Foreign Application Priority Data

Feb. 23, 1987 [JP] Japan ..... 62-39916

[51] Int. Cl.[4] ..... B21J 13/08

[52] U.S. Cl. ..... 72/405; 198/621

[58] Field of Search ..... 72/405; 198/621; 414/752, 751

[56] References Cited

U.S. PATENT DOCUMENTS

| | | | |
|---|---|---|---|
| 3,149,712 | 9/1964 | Soman . | |
| 3,609,843 | 10/1971 | Fiegel, Jr. . | |
| 3,939,992 | 2/1976 | Mikulec | 198/621 |
| 4,133,199 | 1/1979 | Shirao | 72/421 |
| 4,228,993 | 10/1980 | Cathers . | |
| 4,259,052 | 3/1981 | Imanishi . | |
| 4,361,413 | 11/1982 | Toda | 100/207 |
| 4,428,221 | 1/1984 | Owens . | |
| 4,625,540 | 12/1986 | Yamada . | |
| 4,658,626 | 4/1987 | Yamada . | |

FOREIGN PATENT DOCUMENTS

| | | | |
|---|---|---|---|
| 3320830 | 12/1984 | Fed. Rep. of Germany | 72/405 |
| 25060 | 10/1968 | Japan | 72/405 |
| 57-134224 | 8/1982 | Japan . | |
| 60-174297 | 9/1985 | Japan . | |
| 61-167225 | 10/1986 | Japan . | |
| 597475 | 3/1978 | U.S.S.R. | 72/405 |
| 2028699 | 3/1980 | United Kingdom . | |
| 2134826 | 8/1984 | United Kingdom | 72/405 |
| 2175868 | 12/1986 | United Kingdom . | |

*Primary Examiner*—Daniel C. Crane

*Attorney, Agent, or Firm*—Birch, Stewart, Kolasch & Birch

[57] ABSTRACT

A workpiece transfer device in a press machine simultaneously transfers workpieces from die assembly to die assembly for each pressing cycle. The workpiece transfer device includes two vertically movable bars extending along a direction in which the workpieces are transferred through the press machine, the movable bars being vertically movable by a lifting/lowering mechanism, two feed bars mounted respectively on the vertically movable bars and axially movable by a moving mechanism, and a plurality of handling bars detachably mounted on the feed bars and each having a plurality of workpiece holders for holding the workpieces.

5 Claims, 4 Drawing Sheets

52
60
64
68
66
70
30
72
36
32
40
42
46
58
54
56
77e
38
77d
77c
N
77b
50
77a
77
2
34
62
61
44
43

WORKPIECE TRANSFER DEVICE FOR PRESS MACHINEpcl BACKGROUND OF THE INVENTION

1. Field of the Invention:

The present invention relates to a workpiece transfer device in a press machine for simultaneously transferring a plurality of workpieces from die assembly to die assembly.

2. Description of the Relevant Art:

In some press machines, workpieces are simultaneously moved to respective die assemblies and pressed thereby in one pressing cycle. There has been a demand in the field of such press machines for a device capable of efficiently supplying the workpieces to the die assemblies.

To meet such a demand, a workpiece transfer device has been proposed as disclosed in Japanese LaidOpen Utility Model Publication No. 61-167225. The disclosed workpiece transfer device has two vertically movable bars extending in the direction in which the workpieces are transferred and arranged on opposite sides of the workpieces, the bars being vertically movably supported on lifting/lower units. The vertically movable bars support thereon a drive base movable by a drive unit and a plurality of arm bases coupled to the drive base and to each other in series by connecting rods. A pair of handling bars for transferring a workpiece is supported between the confronting arm bases and movable on the vertically movable bars in mutually opposite directions.

For simultaneously transferring the workpieces to the next die assemblies after one pressing cycle is completed, the handling bars are moved to the centers of the die assemblies, and then the handling bars in each pair moved in opposite directions so as to be spaced a distance from each other. The vertically movable bars are lowered and so are the handling bars to cause suction means on the handling bars to hold the workpieces under suction. After the workpieces have been securely held by the suction means, the vertically movable bars are elevated to lift the handling bars. Thereafter, the arm bases are moved to position the workpieces over the lower dies of the respective next die assemblies. The handling bars are lowered again to place the workpieces onto the lower dies. Then, the handling bars are brought closer to each other. Finally, the handling bars are retracted to positions between the die assemblies, and the workpieces are pressed.

With the conventional workpiece transfer device, it is necessary to move the handling bars on the arm bases. The mechanism for moving the handling bars is complex, and as a result the press machine is very costly to manufacture and requires a complicated maintenance procedure.

SUMMARY OF THE INVENTION

It is a major object of the present invention to provide a workpiece transfer device which is simple in construction, highly durable, and capable of efficiently supplying workpieces to a plurality of die assemblies.

According to the present invention, there is provided a workpiece transfer device in a press machine for pressing a plurality of workpieces that can be transferred in a workpiece transferring direction, the workpiece transfer device comprising two vertically movable bars extending along the workpiece transferring direction and vertically movable by a lifting/lowering mechanism, two feed bars mounted respectively on the vertically movable bars and axially movable by moving means, and a plurality of handling bars detachably mounted on the feed bars and each having a plurality of workpiece holder means for holding the workpieces.

Since all of the handling bars are fixed to the feed bars when the workpieces are transferred, it is not necessary to provide a moving mechanism for moving the handling bars.

Each of the handling bars has recesses defined in opposite ends, respectively, thereof, and the feed bars support cylinders having respective axially movable rods which are movable into the recesses. Because the handling bars are detachably mounted on the feed bars, the workpiece holder means can easily be replaced with new ones.

The workpiece transfer also includes a plurality of handling bar gripping devices disposed closely to the opposite ends of the handling bars, each of the handling bar gripping devices comprising a body and a swing arm angularly movably mounted on the body for gripping one of the handling bars which has been detached from the feed bars.

The above and further objects, details and advantages of the present invention will become apparent from the following detailed description of a preferred embodiment thereof, when read in conjunction with the accompanying drawings. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
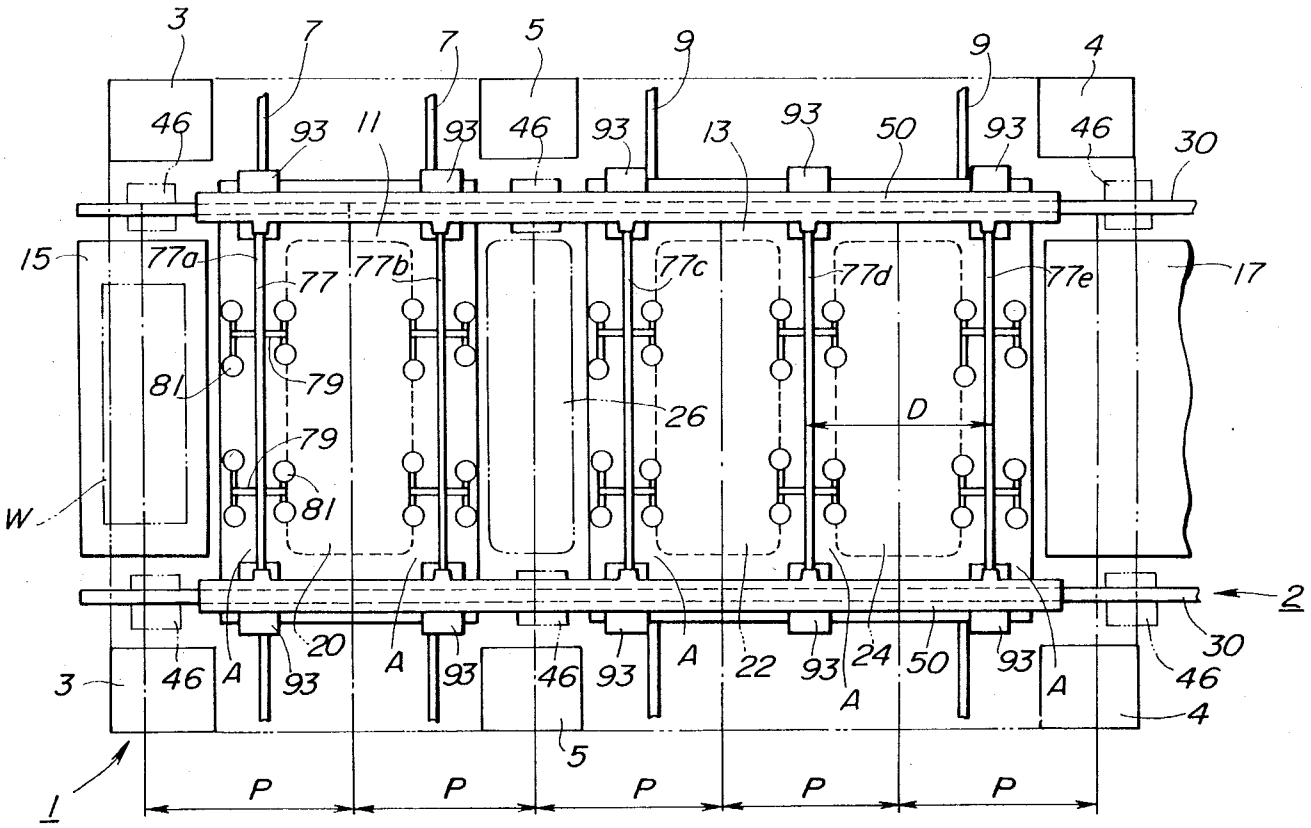
FIG. 1 is a fragmentary plan view of a press machine having a workpiece transfer device according to the present invention.

As shown in FIG. 1, a press machine 1 has a workpiece transfer device 2, four upstanding corner columns 3, 4 and two upstanding central columns 5 each positioned between one pair of corner columns 3, 4. A pair of guide rails 7 is disposed between the corner columns 3 and the central columns 5 and extends in a direction normal to the longitudinal direction of the press machine 1, i.e., perpendicular to the direction in which a workpiece W is transferred. A pair of guide rails 9 is disposed between the corner columns 4 and the central columns 5 and extends in a direction normal to the longitudinal direction of the press machine 1, i.e., perpendicular to the direction in which a workpiece W is transferred. First and second mobile bolsters 11, 13 are movable along the respective pairs of guide rails 7, 9 into and out of the press machine 1 by suitable drive means. A loading station 15 is located upstream (leftward in FIG. 1) of the first mobile bolster 11 with respect to the workpiece transferring direction. A workpiece W to be pressed is supplied to the loading station 15. An unloading station 17 is located downstream (rightward in FIG. 1) of the second mobile bolster 13 with respect to the workpiece transferring direction. A workpiece W that has been pressed is unloaded from the unloading station 17.

A lower drawing die 20 is mounted on the upper surface of the first mobile bolster 11. A lower trimming die 22 and a lower punching die 24 adjacent thereto are mounted on the upper surface of the second mobile bolster 13. These lower dies 20, 22, 24 are arranged in a row along the workpiece transferring direction. A workpiece stock station 26 for temporarily placing a workpiece w thereon is disposed between the first and second mobile bolsters 11, 13 and also between the central columns 5. The longitudinal central lines of the stations 15, 17, 26 and the longitudinal central lines of the lower dies 20, 22, 24 on the first and second mobile bolsters 11, 13 disposed adjacent to the respective stations are equally spaced at intervals or distances P. An upper drawing die (not shown) is supported on a die holder (not shown) which is vertically movable along the corner columns 3, 4 and the central columns 5, and an upper trimming die (not shown) and an upper punching die (not shown) are supported on respective die holders which are vertically movable along the corner columns 3, 4 and the central columns 5. The upper drawing die is provided separately from the other upper dies, i.e., on one side of the central columns 5 which is opposite to the other upper dies, for the reason that the upper drawing die will operate differently from the other upper dies.

Figures 2, 3:
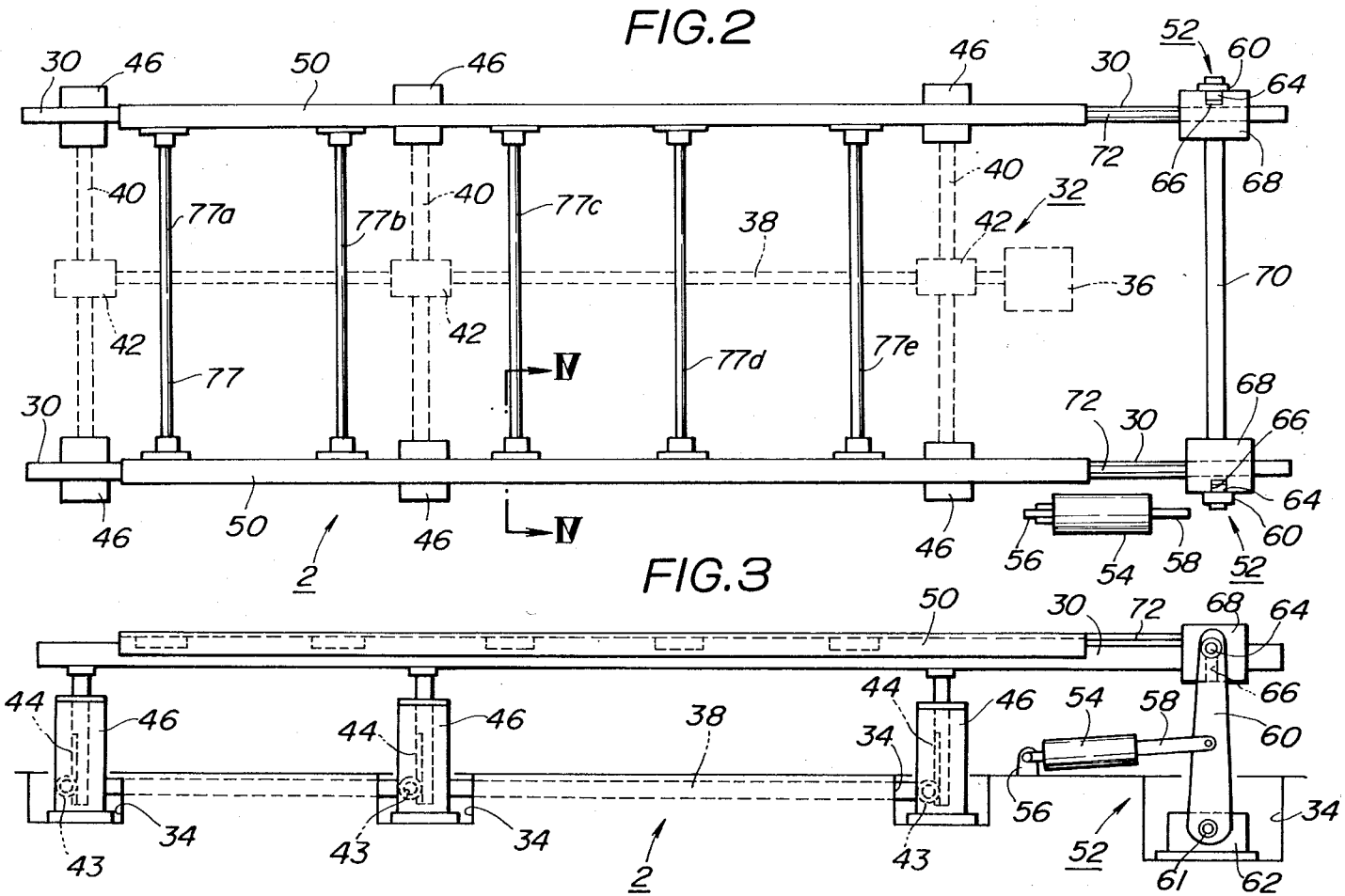
FIG. 2 is a view similar to FIG. 2, explaining a lifting/lowering mechanism for lifting and lowering vertically movable bars and a moving mechanism for moving feed bars on the vertically movable bars, with mobile bolsters and other components not being illustrated.
FIG. 3 is a side elevational view of the workpiece transfer device shown in FIG. 2.

As shown in FIGS. 2 and 3, the workpiece transfer device 2 has two vertically movable bars 30 extending along the workpiece transferring direction and disposing between the corner columns 3, 4 and the central columns 5 and the first and second mobile bolsters 11, 13. The vertically movable bars 30 are supported on and vertically movable by a lifting/lowering mechanism 32. The lifting/lowering mechanism 32 is disposed in a floor pit 34 and comprising a rotative drive source 36, a driver shaft 38 extending parallel to the bars 30 and coupled to the rotative drive source 36, and a plurality of driver shafts 40 extending perpendicularly to the driver shaft 38 and coupled thereto through gear assemblies 42 so that rotative power of the driver shaft 38 can equally be transmitted to the driven shafts 40. As shown in FIG. 3, the driven shafts 40 have gears 43 mounted on their opposite ends and held in mesh with respective racks 44 which are vertically slidable in respective posts 46 disposed vertically in the pit 34. The racks 44 have upper ends held against the vertically movable bars 30 at all times. The posts 46 are disposed on opposite sides of the first and second mobile bolsters 11, 13 as indicated by the broken lines in FIG. 1 such that the posts 46 will not obstruct movement of the first and second mobile bolsters 11, 13 in a direction normal to the workpiece transferring direction.

Feed bars 50 are mounted respectively on the vertically movable bars 30 and are axially slidable by a moving mechanism 52 (FIG. 3). The moving mechanism 52 comprises a swing cylinder 54 having one end coupled to a support 56 and having an axially movable rod 58 and two swing arms 60 each having one end pivotally coupled by a pivot pin 61 to a support base 62 disposed in the floor pit 34, one of the swing arms 60 being coupled at its intermediate portion to one end of the rod 58. The upper ends of the swing arms 60 have guide pins 64, respectively, projecting inwardly toward each other and fitted respectively in vertical grooves 66 defined in two drive bases 68. The drive bases 68 are substantially C-shaped in cross section and are interconnected by a bar 70. The drive bases 68 are fitted respectively over the vertically movable bars 30 and coupled to the feed bars 50 through respective connecting bars 72.

When the rod 58 of the swing cylinder 54 is moved back and forth, the feed bars 50 are caused to slide back and forth on the bars 30. More specifically, when the rod 58 is extended, the swing arms 60 are angularly moved to the right in FIG. 3 to move the drive bases 68 to the right on the bars 30 for thereby causing the feed bars 50 coupled to the drive bases 68 to move to the right. Conversely, when the rod 58 is retracted, the swing arms 60 are swung to the left to move the drive bases 68 to the left on the bars 30 for thereby causing the feed bars 50 to move to the left. As shown in detail in FIG. 4, rollers 75 are mounted on upper and lateral sides of each of the bars 30 for allowing the corresponding feed bar 50 to move smoothly on the bar 30. Rollers (not shown) are also mounted on each of the drive bases 68 to allow them to move smoothly on the bars 30.

The vertical movement of the vertically movable bars 30 and the slding movement of the feed bars 50 are related to the vertical movement of the upper dies through a link mechanism and cams (not shown).

A plurality of handling bars 77 (more specifically 77*a* through 77*e*) extend between and more joined to the feed bars 50. Adjacent handling bars 77*a* through 77*e* are spaced from each other by a distance D which is equal to the distance P between adjacent stations 15, 17, 26 and the lower dies 20, 22, 24. A plurality of suction members, i.e., vacuum cups 81 serving as workpiece holders are supported on each of the handling bars 77*a* and 77*e* by means of detachable support members 79 for holding workpieces W under suction.

Figure 4:
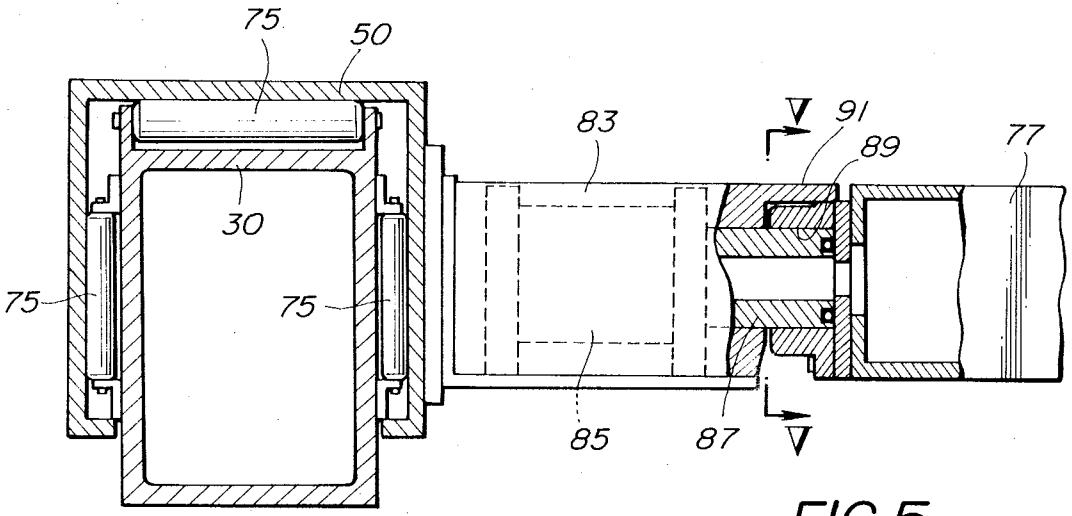
FIG. 4 is a cross-sectional view taken along line IV—IV of FIG. 2.
Figure 5:
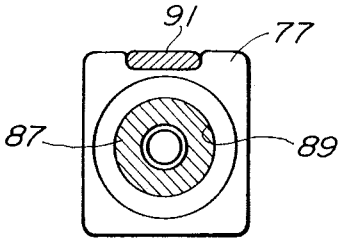
FIG. 5 is a cross-sectional view taken along line V—V of FIG. 4.

As shown in FIGS. 4 and 5, each feed bar 50 has a plurality of connectors 83 (only one shown in FIGS. 4 and 5) on an inner side thereof. In the connector 83, there is mounted a cylinder 85 having an axially movable rod 87. The handling bar 77 has a recess 89 defined in each of its opposite ends. When the rod 87 is extended, its tip end is inserted into the corresponding recess 89. The connector 83 has a ridge 91 projecting from its distal end for engaging the handling bar 77 for limiting its height and rotation.

Figure 6:
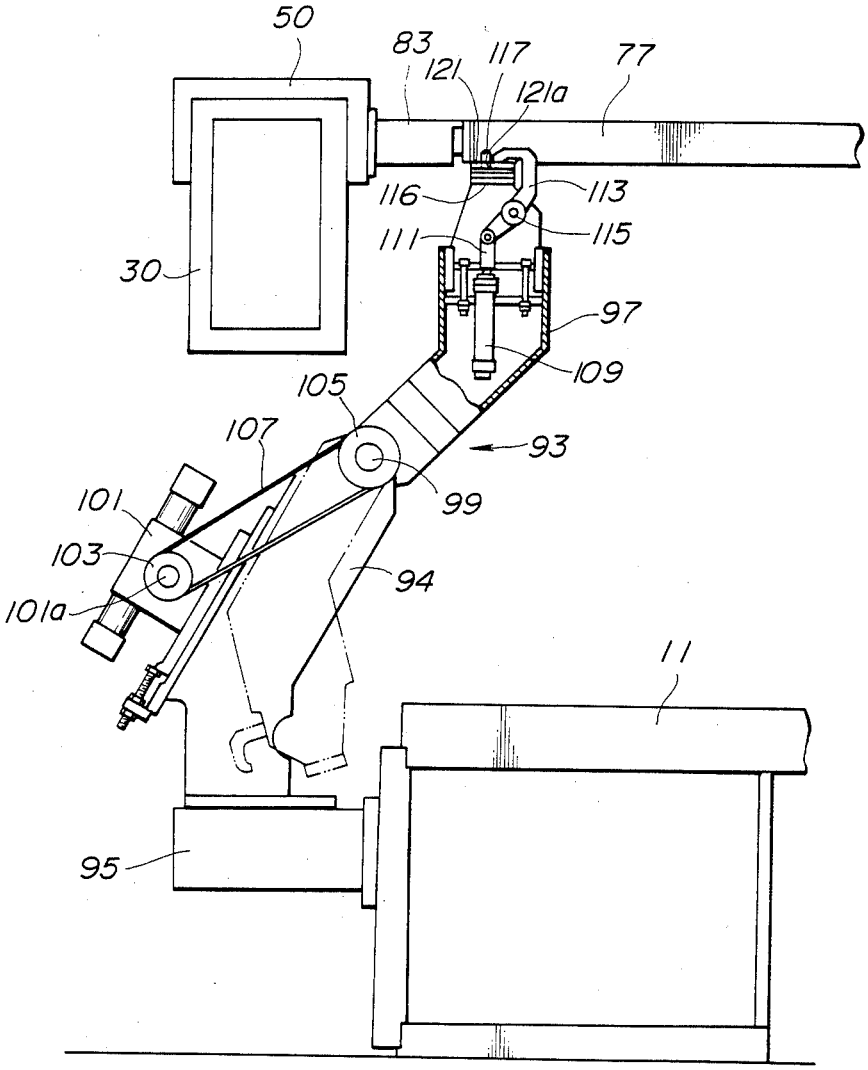
FIG. 6 is a side elevational view, partly in cross section, of a handling bar gripping device in the workpiece transfer device shown in FIG. 1.

There are provided a total of ten handling bar gripping devices, generally designated by the reference numeral 93 in FIG. 1. As shown in FIG. 6, each handling bar gripping device 93 comprises a body 94 mounted on a support bar 95 projecting from a side of the mobile bolster and a swing arm 97 angularly movably mounted on the body 94 by a support shaft 99. The swing arm 97 is turned by a drive unit 101 which produces rotative power that is transmitted to the support shaft 99 by means of a power transmitting device. The power transmitting device comprises a sprocket 103 fixed to an output shaft 101a of the drive unit 101, a sprocket 105 fixed to one end of the support shaft 99, and a chain belt 107 trained around the sprockets 103, 105. A hydraulic cylinder 109 is supported in the swing arm 97 by means of a plurality of suitable attachment members. The hydraulic cylinder 99 has an axially movable rod 111 with its distal and pivotally coupled to a finger 113 for turning movement about a pivot pin 115. A support plate 116 having a positioning pin 117 is attached to the upper end of the swing arm 97. The positioning pin 117 can engage in a hole 121a defined in a bearing plate 121 fixed to the lower surface of an end of the handling bar 77.

When rotative power from the drive unit 101 is transmitted to the support shaft 99, the swing arm 97 is angularly moved from the broken-line position to the solid-line position in FIG. 6, in which the support plate 116 abuts against the bearing plate 121 and the positioning pin 117 is inserted into the hole 121a to position the swing arm 97 with respect to the handling bar 77. Thereafter, the rod 111 of the cylinder 109 is retracted to turn the finger 113 counterclockwise in FIG. 6 for causing the distal end of the finger 113 to engage and press the bearing plate 121 against the support plate 115. Since the handling bar gripping devices 93 are located at the opposite ends of each of the handling bars 77, the handling bar 77 is securely gripped by the handling bar gripping device 93.

During a pressing process, the handling bars 77 are located in retracted positions A on both sides of the lower dies 20, 22, 24. Upon completion of the pressing process, the upper dies are elevated, and the rotative drive source 36 is actuated. The racks 44 are now lifted by the rotative drive source 36 through the drive shaft 38 and the driven shafts 40 to elevate the feed bars 50 and hence the vertically movable bars 30.

Then, the rod 58 of the swing cylinder 54 is retracted to turn the swing arms 60 counterclockwise. The drive bases 68 are moved to the left (FIG. 1) on the bars 30 to move the feed bars 50 a distance which is half ($\frac{1}{2}$ P) the distance P between the central line of the loading station 15 and the central line of the first mobile bolster 11. Thereafter, the feed bars 50 are lowered to their prescribed positions by the lifting/lowering mechanism 32. The vacuum cups 81 on the handling bar 77*a* attract and hold a workpiece W to be pressed on the loading station 15, and the vacuum cups 81 on the handling bar 77*b* attract and hold a workpiece W on the lower drawing die 20. At the same time, the vacuum cups 81 on the handling bar 77*c* attract and hold a workpiece W on the workpiece stock station 26, and the vacuum cups 81 on the handling bars 70*d*, 70*e* attract and hole respective workpieces W on the lower trimming and punching dies 22, 24.

Thereafter, the lifting/lowering mechanism 32 is actuated again to elevate all of the handling bars 77 with the workpieces W held thereby. After the handling bars 77 have been elevated, the rod 58 of the swing cylinder 54 is extended to turn the swing arms 60 clockwise to the right in FIG. 3 by such an angular interval as to move the feed bars 50 a distance equal to the distance P between the central line of the loading station 15 and the central line of the first mobile bolster 11, for example. When the workpieces W are positioned directly above the lower dies, the bars 30 are lowered by the lifting/lowering mechanism 32 to set the workpieces W on the respective lower dies and stations. Thereafter, the handling bars 77 are returned to the respective retracted positions A by the lifting/lowering mechanism 32 and the moving mechanism 52. The upper dies (not shown) are then lowered with their die holders to press the workpieces W on the lower dies.

A process of carrying the lower dies and the handling bars out of the press machine 1 will be described below.

The handling bars 77 located in their respective retracted positions A are lowered a prescribed distance by the lifting/lowering mechanism 32. Then, the die holders holding the upper dies are lowered, and the upper and lower dies are aligned and mated with each other. Thereafter, the upper dies are released from the die holders thereof and placed on the lower dies.

The handling bar gripping devices 93 are operated in the manner described above for gripping the handling bars 77. Thereafter, the rod 87 of the cylinder 85 is retracted to disconnect the connector 83 of the feed bar 50 from the handling bar 77. The handling bar 77 is now only held by the handling bar gripping device 93. The vertically movable bar 30 is lifted to a position out of physical interference with movement of the handling bar 77. The first and second second mobile bolsters 11, 13 are moved along the guide rails 7, 9 to deliver the upper and lower dies, the handling bar 77, and the handling bar gripping devices 93 out of the press machine 1. New bolsters may be carried into the press machine 1 along the guide rails 7, 9 from a side opposite to the side where the old bolsters were carried out of the press machine 1.

If a different pressing process should be carried out, the dies are replaced with new ones after the first and second mobile bolsters have been carried out of the press machine 1. At this time, the existing vacuum cups 81 on the handling bars are replaced with new vacuum cups or workpiece holders. The replacement procedure may be effected efficiently by employing handling bars which are combined in advance with workpiece holders.

Although there has been described what is at present considered to be the preferred embodiment of the present invention, it will be understood that the invention may be embodied in other specific forms without departing from the spirit or essential characteristics thereof. The present embodiment is therefore to be considered in all aspects as illustrative, and not restrictive. The scope of the invention is indicated by the appended claims rather than by the foregoing description.

We claim:

1. A workpiece transfer device in a press machine for pressing a plurality of workpieces that can be transferred in a workpiece transferring direction between stations, said workpiece transfer device comprising:

(a) two vertically movable bars extending along said workpiece transferring direction and vertically movable by a lifting/lowering mechanism;

(b) two feed bars mounted respectively on said vertically movable bars and axially movable relative to said movable bars by moving means to move said feed bars in said workpiece transferring direction between the stations;

(c) a plurality of handling bars detachably mounted on said feed bars and each having a plurality of workpiece holder means for holding the workpieces;

(d) means for detaching said handling bars from said feed bars; and (e) a plurality of handling bar gripping devices disposed closely to opposite ends of said handling bars, said handling bar gripping devices being separate from said movable bars and feed bars, each of said handling bar gripping devices including a body and a swing arm angularly movably mounted on said body for movement between a first position and a second position, said swing arms being spaced from said handling bars in said first position and being in engagement with said handling bars in said second position for gripping one of the handling bars which has been detached from said feed bars so that said detached handling bars are supported in a predetermined orientation.

2. The workpiece transfer device according to claim 1, wherein said workpiece holder means comprises a plurality of support members detachably mounted on said handling bar and a plurality of suction members supported on said support members for holding the workpieces under suction.

3. The workpiece transfer device according to claim 1, wherein said of said handling bars has a bearing plate attached to the lower surface of each end thereof and having a hole, said swing arm of each of said handling bar gripping devices having a support plate including a positioning projection and a swingable gripping member, the arrangement being such that after said positioning projection has been inserted in said hole, said bearing plate is pressed against said support plate by said swingable gripping member.

4. The workpiece transfer device according to claim 1, wherein said handling bar detaching means includes a recess defined in opposite ends of each of said handling bars, and a cylinder mounted in each of the feed bars and having an axially movable rod insertable into the recess.

5. A workpiece transfer system for a press machine having a plurality of dies closely arranged to one another in a longitudinal direction of the press machine, said workpiece transfer system comprising:

(a) two elongated bars extending in the longitudinal direction of the press machine and placed near both sides of said dies, respectively, said two bars being vertically movable by cylinder units;

(b) two elongated feed members slidably mounted on said two bars, respectively so as to move relative to said elongated bars and to move a workpiece in the longitudinal direction;

(c) a plurality of lateral handling members each connected between the two feed members and having means for holding the workpieces;

(d) means for disconnecting said handling members from said feed members; and (e) means for gripping the handling members when disconnected from the feed members, said means for gripping being separate from said elongated bars and feed members, said means for gripping being mounted to mobile bolsters movable relative to the press machine, said means for gripping being movable between a first position spaced from said handling members and a second position in engagement with said handling members such that said means for gripping supports said disconnected handling members in a predetermined orientation.

* * * * *